US007540791B1

(12) United States Patent
Dharani

(10) Patent No.: US 7,540,791 B1
(45) Date of Patent: Jun. 2, 2009

(54) UNIVERSAL BATTERY TERMINAL ADAPTOR

(76) Inventor: Murad Dharani, 60, Havelock Gate, Markham, Toronto, Ontario (CA) L3S 3X6

( * ) Notice: Subject to any disclaimer, the term of this patent is extended or adjusted under 35 U.S.C. 154(b) by 0 days.

(21) Appl. No.: 12/134,268

(22) Filed: Jun. 6, 2008

(51) Int. Cl.
*H01R 4/50* (2006.01)

(52) U.S. Cl. ..... 439/772

(58) Field of Classification Search ..... 439/261, 439/822, 509, 772, 773, 774; 606/120; 81/418
See application file for complete search history.

(56) References Cited

U.S. PATENT DOCUMENTS 3,344,334 A * 9/1967 Irwin ..... 320/101
4,664,468 A * 5/1987 Woodworth ..... 439/772
6,623,315 B1 * 9/2003 Roderick ..... 439/772

* cited by examiner

*Primary Examiner*—Neil Abrams
*Assistant Examiner*—Phuong Nguyen

(57) ABSTRACT

A battery terminal connector for connecting to a battery terminal to a battery cable without the use of tools. The connector is of trapezoidal rectangular rounded shape which includes a lateral movable jaw, a movable lever effecting the movement of the jaw, the jaw and lever being lie in the same plane and enclosed by the two body portion. A cap is fitted on one side to cover the battery terminal from exposure to dirt and moisture. A slot is provided on opposite side of the connector for receiving the electric cable. Lateral movement of the jaw portion within and relative to the battery terminal connector effects the closing of a hollow opening. The jaw portion squeezed the cable setting against the battery terminal and thus enabling a secure electrical setting. The connector is made of lightweight material and is having the property of plastic polymer and thermo cold to resist extreme temperature.

9 Claims, 4 Drawing Sheets

UNIVERSAL BATTERY TERMINAL ADAPTOR

TECHNICAL FIELD OF THE INVENTION

The invention relates to a battery terminal accessories and more particularly to a battery terminal connector that can be attached to a battery terminal without the use of tools and a battery connector cap to protect from corrosion of the battery terminal.

BACKGROUND OF THE INVENTION

Most of the battery terminal post of the storage battery, are generally of an upstanding which may be cylindrical or slightly frusto-conical shape. Battery terminal connectors are used for providing an electrical connection between the battery terminal and electrical cable besides providing a secure mechanical connection also.

A conventional connector for connecting cables to the battery may be a socket or clamp generally of U-shape which comprises of a bolt passing through outwardly projecting yoke like arms and a nut. When the nut is tightened on the bolt, the connector tightly grips the battery terminal. The yoke arms move apart when the nut is loosened, thereby loosening the grip of the battery terminal connector on the battery terminal posts. Thus, by moving the yoke arms apart, the battery terminal connector can be removed from the battery terminal. In this case, tools must be used to install or remove the battery terminal connector.

The battery terminal connectors are subjected to shock, vibration, dirt, moisture, corrosion inducing salt spray from the roads, and exposing to high temperature is one of the major factors that can induce corrosion. As a result, the battery terminal connectors comprising of the nuts and bolt are often extremely corroded and in some cases deformed. In order to remove the battery terminal connector from the battery terminal post with the help of tools, the nut or head of the bolt is generally deformed. New replacement of nut and bolt or whole part sometimes, needs to be done. Thus, it would be desirable to provide a battery terminal connector which can be used to facilitate the attachment of the battery terminal connector to the battery terminal post, and at the same time facilitates the removal of a corroded terminal connector from the battery terminal without the need of tools. Besides, cable connectors tend to corrode quickly and often must be replaced.

The present invention is provided to solve the problems discussed above and other problems, and to provide advantage and aspects not provided by the prior art battery terminal connectors.

A full discussion of the features and advantages of the present invention is deferred to the following detailed description, which proceeds with reference to the accompanying drawings.

SUMMARY OF THE INVENTION

The object of the invention is to provide a battery terminal connector which can be attached or removed from the battery terminal post of an electrical storage battery without the use of tool.

A related object is to provide a rectangular trapezoidal rounded cap on one side of the battery terminal connector to cover up the battery terminal post to protect against dust, moisture present in the atmosphere at least to a maximum extent. This will slow down the rate of corrosion and thereby extending the lifetime of the terminal connector.

The battery terminal connector includes a body portion having jaws with teeth facing against the generally hollow opening in the middle for receiving the battery terminal post of the battery.

The terminal connector further includes a movable lever for effecting the two way lateral movement of the jaw portion. More particularly, lateral movement of the jaw portion in the direction away from the terminal post affects an opening or an increase in size of general hollow opening. In contrast, lateral movement of the jaw portion in the opposite direction towards the battery terminal affects the closing or decrease in size of the generally hollow opening.

The lever and jaw portion lie in a horizontal plane between two body portions, a body portion where a cap is fitted on one side and another body portion having an opening for the cable to enter within the battery terminal connector the middle. This arrangement allows the jaw portion to traverse horizontally by the action of the lever.

The lever is characterized by three faces at its cross sectional end, adjacent to the jaw portion. The lever, in combination with the jaw portion of the battery terminal connector, facilitate the attachment and removal of the connector without tools.

In the most preferred embodiment, the lever is movable in one of four position. The hollow opening in the middle of the connector is the largest in the first position of the lever. Under this condition, the battery terminal may be allowed to enter in the opening and at the same time, the electric cable conducting wire may be inserted from sideway into the slot specially provided in the connector for its entry. The next position of the lever is determined by the thickness and the cross sectional size of the conducting wire. The lever in the second position is meant for the wire of greater thickness. The position of the lever in the third position is meant for the wire of relatively smaller thickness and the final and the fourth position is meant for the wire of further smaller size. In all the cases, the teeth associated with the jaw portion, effectively moved by the lever, tightly grips the cable setting against the battery terminal.

Another embodiment of the invention is that the material that make up the body of the battery terminal connector is of lightweight and may be made of polypropylene plastic. The teeth associated with the jaw portion have the property of plastic memory. Plastic memory is the property of the material in which the material on being reheated, try to return to its original shape unless it has been overheated or damaged under extreme temperatures. The advantage is that the material is able to resist extreme temperatures and there is lees chance of deformation of the connector.

An insulating cover may be placed over the lever of the battery terminal connector. This insulating cover reduces the probability of electric shock, and reduces the possibility that electric current could be moved from the battery to the lever, and then to an electrical ground. Another embodiment of the invention is that the body of the battery terminal connector is a thermo cold. Other features and advantages of the invention will be apparent from the following specification taken in conjunction with the following drawings.

DETAILED DESCRIPTION

Figure 1A:
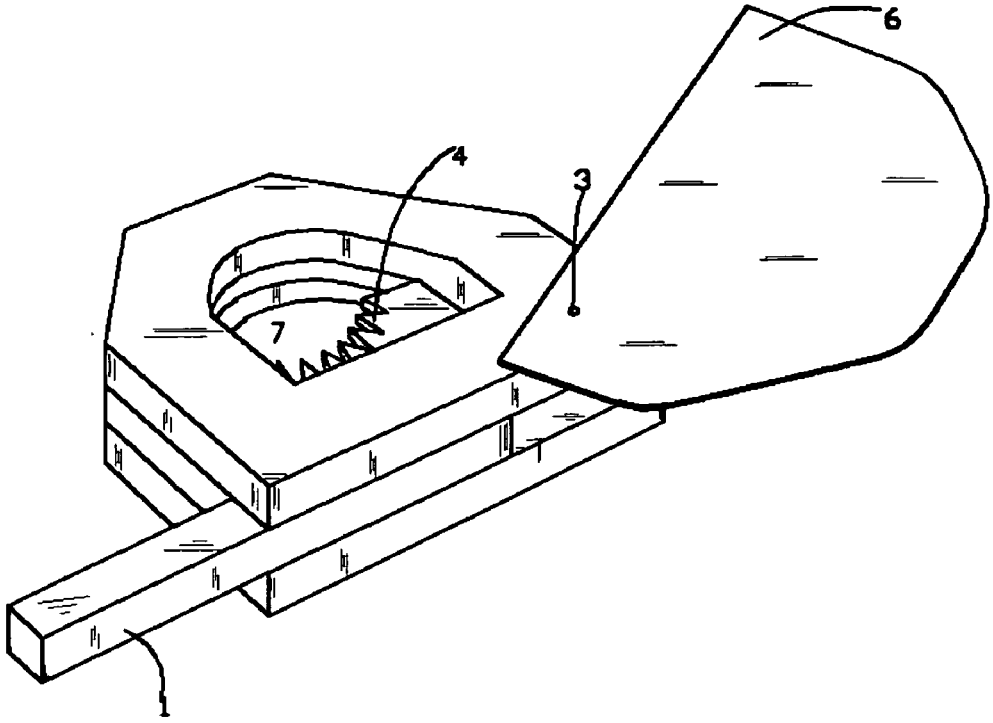
FIG. 1(*a*) and FIG. 1(*b*) is a perspective view of the preferred embodiment of the battery terminal connector at the time of attachment and removal of the battery terminal connector in accordance with the invention.
Figure 1B:
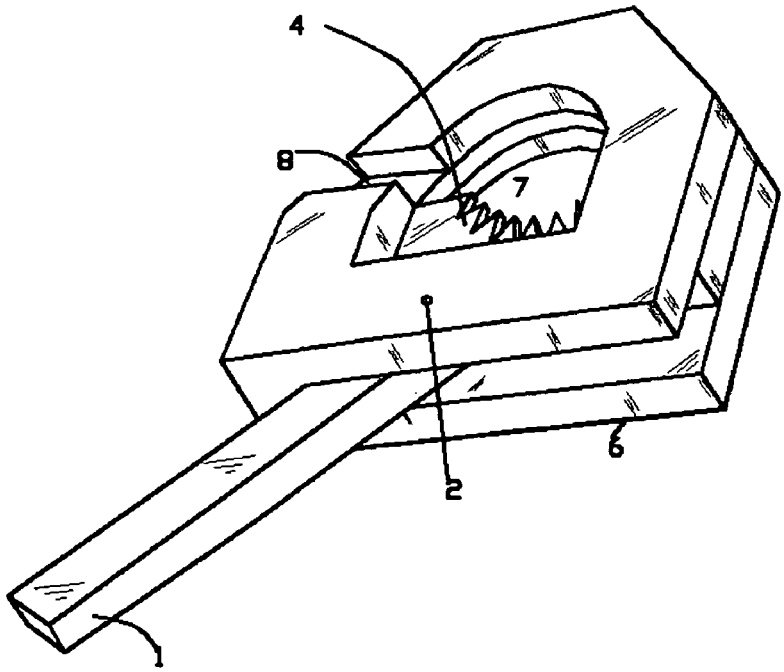
Figure 2:
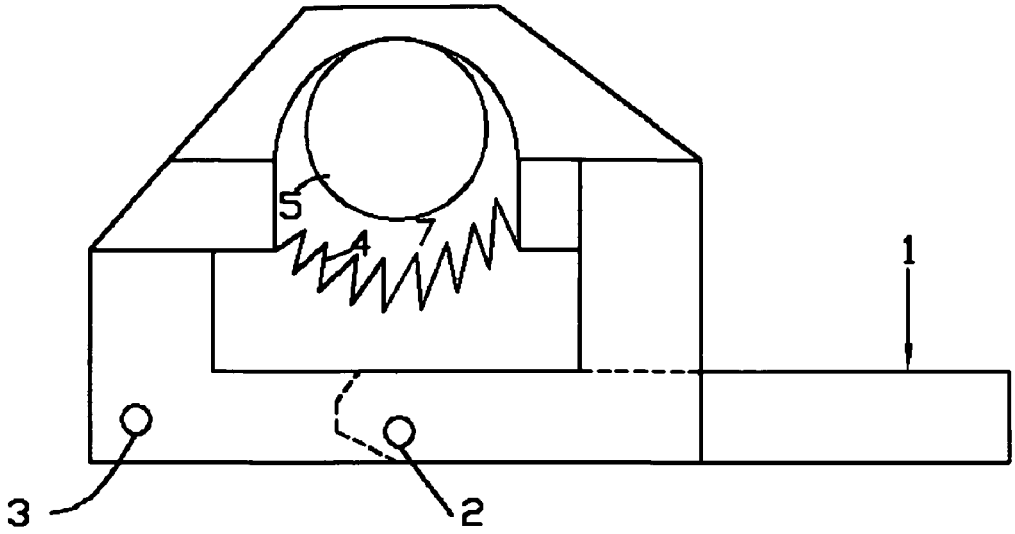
FIG. 2 is a top view of the battery terminal connector of FIG. 1 (*a*)
Figure 3:
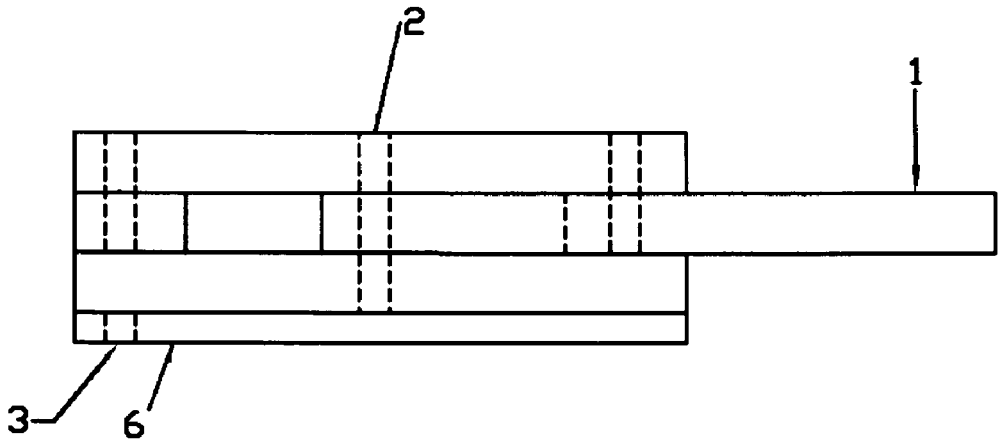
FIG. 3 is the front view of the battery terminal connector of FIG. 1(*a*).
Figure 4:
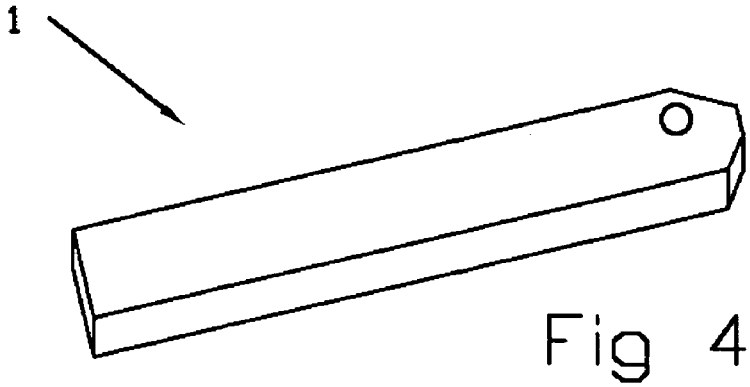
FIG. 4 shows the perspective view of the lever that is one of the components of the embodiment.

The drawings and specifications show in detail a preferred embodiment of the invention. Referring to FIG. 1, the invention is a battery terminal connector. Unlike many terminal connectors of the prior arts, the jaw portion (4) located in the middle portion and movable lever (1) permits the attachment of the terminal connector to the battery terminal post or facilitates the removal of the battery terminal post without the need of tools. It is designed for securement to the battery terminal post of a conventional storage battery besides providing a secure mechanical connection. It includes a hollow opening (7) in the middle to receive and circumscribes against the battery terminal post of the electrical storage battery.

The said invention is characterized by the presence of a rectangular trapezoidal rounded shaped cap (6) located on one side of the battery terminal. The cap cover up the battery terminal post (5) after the connector is attached to the terminal for providing electrical connection therewith. The cap is fitted to the connector through lid pivot (3) at the corner, thus allowing to open and close the hollow opening of the battery terminal connector. It protects against the direct exposure of dust, dirt and moisture present in the atmosphere at least to a great extent. This will slow down the rate of corrosion of terminal, thereby leading to the less formation of the corroded compounds on the battery terminal connector with the result that the life span of the battery terminal connector is extended.

Another embodiment of the invention is that the material that makes up the body of the battery terminal connector is a lightweight and may be of polypropylene plastic. The teeth associated with the jaw portion may have the property of plastic memory. Plastic memory is the property of the material in which the material on being reheated, try to return to its original shape unless it has been overheated or damaged under extreme temperatures. The advantage is that the material is able to resist extreme temperatures and there is less chance of deformation of the connector.

The other side of the battery terminal connector is characterized by the presence of a slot (8) that meets the hollow opening serving as a means for the entry of the electrical cable to have electrical contact with the battery terminal post.

The battery terminal connector further includes a movable lever (1) for effecting the two ways opposite lateral movement of the jaw portion. In the most preferred embodiment the lever is movable in one of four positions. The hollow opening in the middle of the connector is the largest in the first position of the lever. Under this condition, the battery terminal may be allowed to enter in the opening and at the same time, the electric cable conducting wire may be inserted from sideway into the slot specially provided in the connector for its entry. The next position of the lever is determined by the thickness and the cross sectional size of the conducting wire. The lever in the second position is meant for the wire of greater thickness. The position of the lever in the third position is meant for the wire of relatively smaller thickness and the final and the fourth position is meant for the wire of further smaller size. In all the cases, the teeth associated with the jaw portion, effectively moved by the lever, tightly grips the cable setting against the battery terminal.

Figure 5:
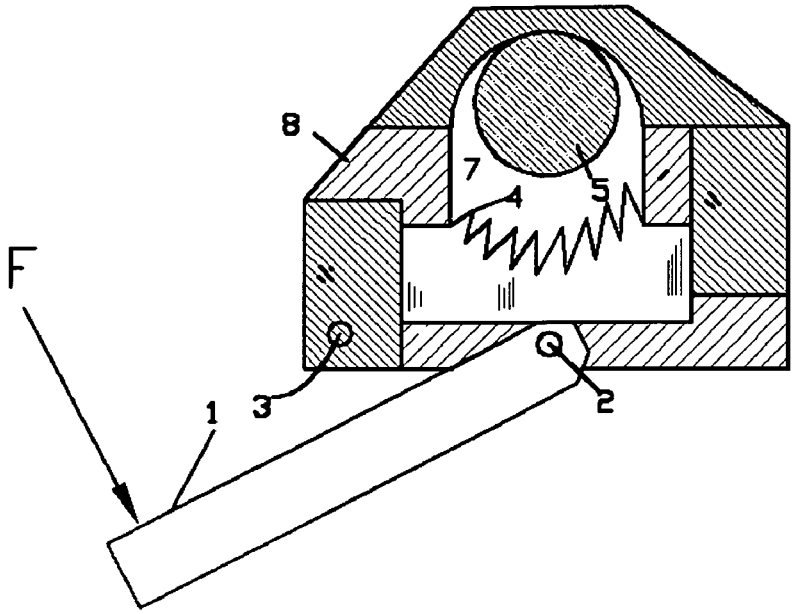
FIG. 5 is a partial sectional view of the battery terminal connector of FIG. 1(*b*) with the lever in the first position and cap upside down.
Figure 6:
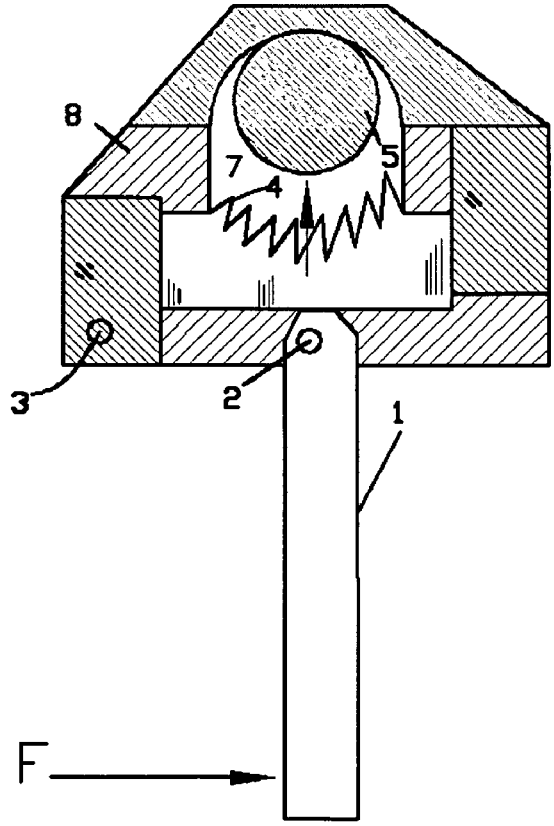
FIG. 6 is a partial sectional view of the battery terminal connector of FIG. 1(*b*) with lever in the second position.
Figure 7:
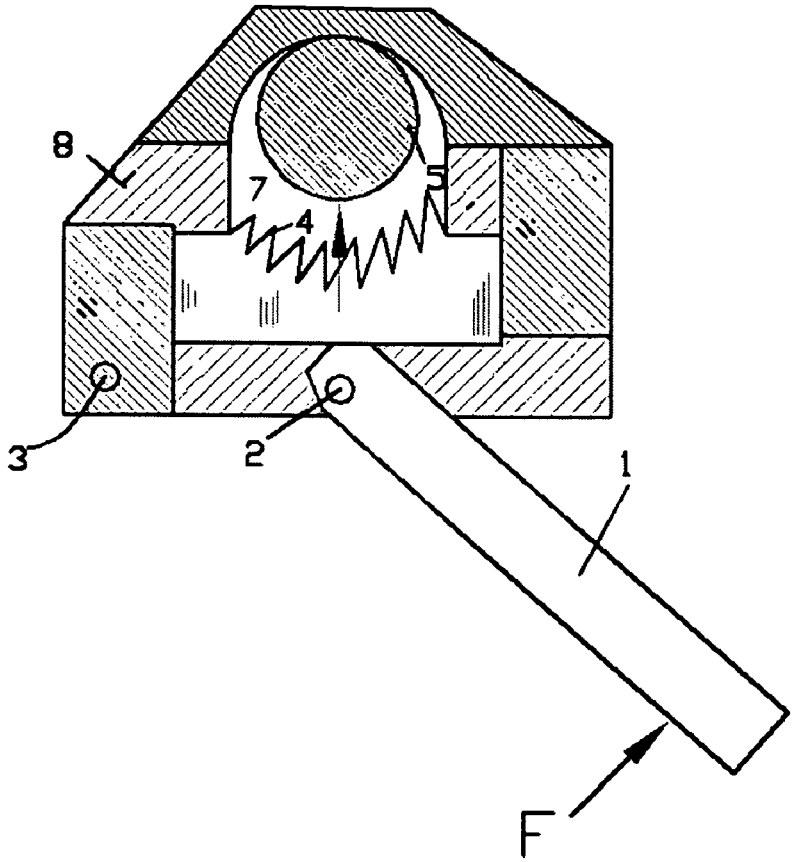
FIG. 7 shows the partial sectional view of battery terminal connector of FIG. 1(*b*) with lever in the third position.
Figure 8:
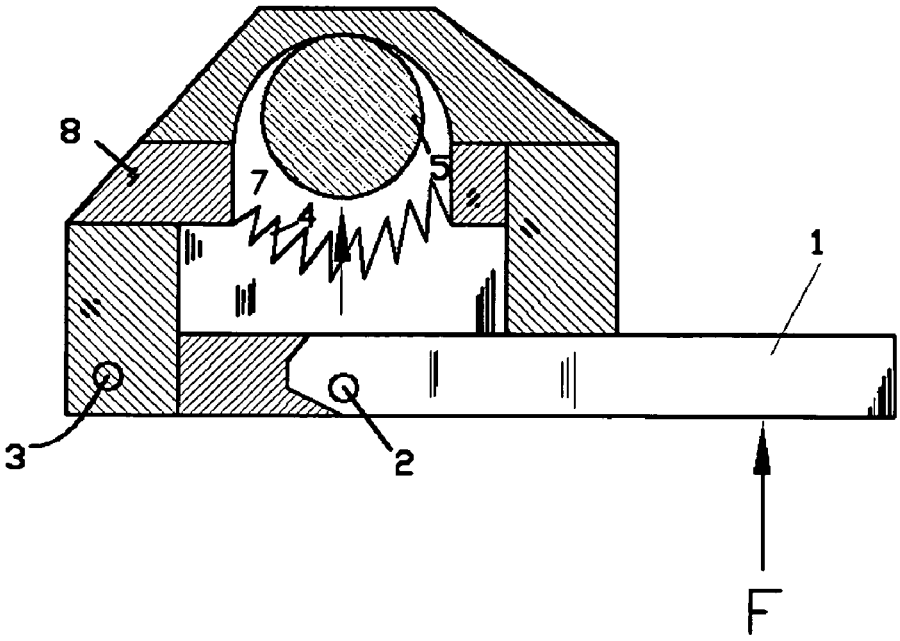
FIG. 8 shows the partial sectional view of battery terminal connector of FIG. 1(*b*) with lever in the fourth position.

The lever is characterized by the presence of three faces at the end adjacent to the jaw portion and the other end for effecting its movement. The face in contact with the jaw portion corresponds to a position of the lever. When the jaw portion is positioned as may be seen in the FIG. 5, the size of the opening is at its maximum. Using directions based upon the orientation of the battery terminal connector depicted on figures, as the lever is moved counterclockwise from the first position of FIG. 5 to the second position of FIG. 6, the jaw portion is urged by the lever towards the terminal post within and relative to the battery terminal connector. It causes a corresponding decrease in the size of the generally circular hollow opening. Assuming that the electrical conducting cable has been inserted in between the battery terminal and jaw portion through the slot (8) provided on the connector, the jaw squeeze the cable setting under the action of the lever and fixed in that position if it meets the electrical and mechanical securement. The requirement for the electrical securement depends on the size of the electrical cable which is being inserted to the connector. When the lever is moved from the second position of FIG. 6 to the third position of FIG. 7, the lever pushes the jaw portion allowing to move further towards the battery terminal. The hollow opening of the connector attains an intermediate size and the jaw portion grips the cable setting with the battery terminal more tightly. Further, when the lever is moved counterclockwise from the third position to the fourth and last position, the size of the hollow opening is at its minimum and the jaw grips the battery terminal with maximum tightness.

In order to remove the battery terminal connector from the battery terminal of the storage battery, the lever is pulled back to the first position. The jaw is allowed to move apart from the battery terminal thereby loosening the cable setting as well as loosening the gripping of the jaw. Subsequently, the connector can be removed from the battery terminal or the cable setting can be effectively removed from the connector.

Another embodiment of the invention is that the external body of the battery terminal connector is made of preferably an insulating material in case to avoid any electrical shock when being mishandled. This insulating material reduces the possibility of electric shocks, and reduces the possibility that electric current could move from the battery to the lever, and then to the electrical ground.

Another embodiment of the invention is that the body of the connector is a thermo cold to resist against extreme temperature.

It will be apparent from the foregoing description that the battery terminal connector according to any of the embodiments of the present invention satisfies the need of the user to attach the battery terminal without the use of tools.

What is claimed is:

1. A battery terminal connector to a cable the said connector comprising a hollow generally circular opening in the middle, a jaw portion with teeth and a movable lever; the jaw and the lever being enclosed by two body portions as three parallel planar surfaces;

wherein the lever is movable from the first position in which the general circular opening of the battery terminal connector is maximum, to a second position in which the generally circular opening of the battery terminal connector is relatively small when the jaw portion moves closer towards the battery terminal, third position in which the jaw portion further moves towards the terminal and fourth position in which the jaw tightly grips the cable setting to the battery terminal;

wherein the hollow opening in the middle of the connector is the largest in the first position of the lever to allow for the electrical conducting cable to enter and to receive the battery terminal; the next position of the lever is determined by the thickness and the cross sectional size of the conducting wire; the lever in the second position is meant for the wire of greater thickness; the position of the lever in the third position is meant for the wire of relatively smaller thickness and the final and the fourth position is meant for the wire of further smaller size;

the teeth associated with the jaw portion, effectively moved by the lever, tightly grips the cable setting against the battery terminal.

2. The battery terminal connector of claim 1, wherein a rectangular trapezoidal rounded cap is attached to one side of the connector.

3. The battery terminal connector of claim 1, wherein one side of the connector is characterized by the presence of slot meeting the generally circular opening of the connector; allowing the entry of the electrical cable within the connector for electrical contact with the battery terminal.

4. The battery terminal connector of claim 1, wherein the connector can be attached or removed from the battery terminal without the use of tool.

5. The battery terminal connector of claim 1, wherein the lateral end of the lever is characterized by the three surfaces shaped by sharp bending of its corner in such a way that the surface in contact with the adjacent surface of the jaw portion determine the said four positions of the lever.

6. The battery terminal connector of claim 1, wherein the lever pushes the jaw portion to effect that lateral movement of the jaw in the direction towards the terminal.

7. The battery terminal connector of claim 1, wherein the material that makes up the body of the battery terminal connector is of lightweight and may be of polypropylene plastic; the teeth associated with the jaw portion may have the property of plastic memory.

8. The battery terminal connector of claim 1, wherein the body of the connector is a thermo cold.

9. The battery terminal connector of claim 1, wherein the external body of the battery terminal connector is made of preferably an insulating material in case to avoid any electrical shock when being mishandled.

* * * * *